US006769409B2

(12) United States Patent
Evancik et al.

(10) Patent No.: US 6,769,409 B2
(45) Date of Patent: Aug. 3, 2004

(54) FUEL INJECTOR SUPPORTING DEVICE

(75) Inventors: Michael Joseph Evancik, Chillicothe, IL (US); Marvin Patrick Schneider, East Peoria, IL (US)

(73) Assignee: Caterpillar Inc, Peoria, IL (US)

( * ) Notice: Subject to any disclaimer, the term of this patent is extended or adjusted under 35 U.S.C. 154(b) by 37 days.

(21) Appl. No.: 10/268,990

(22) Filed: Oct. 11, 2002

(65) Prior Publication Data

US 2004/0069280 A1 Apr. 15, 2004

(51) Int. Cl.[7] ..... F02M 55/02
(52) U.S. Cl. ..... 123/470; 123/463
(58) Field of Search ..... 123/470, 463, 123/446, 467, 468, 469, 472

(56) References Cited

U.S. PATENT DOCUMENTS 4,206,725 A 6/1980 Jenkel et al.
5,325,834 A * 7/1994 Ballheimer et al. ..... 123/446
5,566,658 A * 10/1996 Edwards et al. ..... 123/470
5,699,770 A * 12/1997 Matsumoto et al. ..... 123/470
6,196,194 B1 3/2001 Mitchell
6,269,798 B1 * 8/2001 Takahashi et al. ..... 123/470
6,279,516 B1 * 8/2001 Haugen et al. ..... 123/41.82 R
6,431,152 B1 * 8/2002 Estacio ..... 123/470

* cited by examiner

*Primary Examiner*—Mahmoud Gimie
(74) *Attorney, Agent, or Firm*—Finnegan, Henderson, Farabow, Garrett & Dunner

(57) ABSTRACT

A fuel injector support assembly for mounting a fuel injector to the cylinder head of an engine. The fuel injector support assembly includes a fuel injector clamp attached to a bracket. The bracket is secured to the cylinder head by cylinder head mounting bolts, which are used also to fasten the cylinder head to the engine block. The fuel injector clamp is attached to the bracket and secures the fuel injector to the cylinder head.

22 Claims, 3 Drawing Sheets

FUEL INJECTOR SUPPORTING DEVICE

TECHNICAL FIELD

This invention relates generally to fuel injection systems and, more particularly, to a fuel injector support assembly mounted to a cylinder head of an engine.

BACKGROUND

Support clamps for fuel injectors are known in the industry. Generally, these clamps mate with the fuel injector and are secured to the cylinder head of an engine using a fastener that extends directly into the deck of the cylinder head. U.S. Pat. No. 4,206,725 (the '725 patent) discloses an example of one such fuel injector clamp. Specifically, the '725 patent describes a fuel injector nozzle that is mounted to a cylinder head of an engine using a clamp. This clamp includes two leg portions that engage the fuel injector nozzle and force the nozzle into place when the clamp is mounted to the cylinder head.

For mounting to the cylinder head, the clamp of the '725 patent relies upon the use of a fastener that extends through the clamp body and directly into the cylinder head. Specifically, the '725 patent discloses a bolt having a threaded shank. To fasten the clamp to the cylinder head, the threaded shank of the bolt is tightened into a complimentary threaded bore located in the cylinder head. The threaded bore in the cylinder head is a dedicated mounting hole because it serves no other function than to mount the support clamp to the cylinder head.

Fuel injector clamps that attach to the cylinder head with a fastener tightened directly into a dedicated mounting hole in the cylinder head may add a structural weakness to the cylinder head. This is notable because there is a trend among engine manufacturers to increase the cylinder pressure during operation of an engine in order to increase the power density of the engine structure. As cylinder pressures increase, a weak point on the cylinder head, namely the area of the cylinder head delimited by the hole for the fuel injector and the dedicated mounting hole for the fuel injector clamp, has an increasing likelihood of failure. Also, the threaded area of the mounting hole itself may fail under the increased load imparted to the threads by the cylinder pressure.

Direct-mount fuel injector clamps also may complicate the design and production of the cylinder head and, therefore, add to fabrication costs. Because these types of fuel injector clamps are mounted directly to the cylinder head, the area of the cylinder head that receives the clamp fastener may be reinforced with added material. Specifically, a boss is added to the cylinder head, and the boss must have a depth sufficient to accept the full length of the threaded bore of the fastener without allowing penetration of the fastener into the cylinder. The inclusion of an additional boss on the cylinder head adds to the cost of the cylinder head.

Additionally, direct-mount fuel injector clamps may lead to a reduction in the cooling efficiency of the engine. Particularly, the additional material on the cylinder head required to accept the fuel injector clamp fastener increases the volume of material that acts as a heat sink and must be cooled. By increasing the volume of material to be cooled, the cooling efficiency of the engine may be reduced.

The present invention solves one or more of the problems associated with known fuel injector support devices.

SUMMARY OF THE INVENTION

One aspect of the present invention includes an engine that has a cylinder head mounted to an engine block using a plurality of cylinder head mounting bolts. A bracket is mounted to the cylinder head using at least one of the cylinder head mounting bolts. A fuel injector clamp attaches to the bracket and retains the fuel injector.

A second aspect of the present invention includes a method of fastening a fuel injector to an engine. This method includes securing a cylinder head to a block of the engine using a plurality of cylinder head mounting bolts. A fuel injector support assembly is mounted to the cylinder head using at least one of the cylinder head mounting bolts, and the fuel injector is secured to the fuel injector support assembly.

A third aspect of the present invention includes a fuel injector support assembly. This assembly includes a bracket that is configured to mate with at least one mounting boss of a cylinder head of an engine. A fuel injector clamp engages a fuel injector.

BRIEF DESCRIPTION OF THE DRAWINGS

The accompanying drawings, which are incorporated in and constitute a part of this specification, illustrate exemplary embodiments of the invention and, together with the written description, serve to explain the principles of the invention. In the drawings.

DETAILED DESCRIPTION

In the following description, reference is made to the accompanying drawings that form a part thereof, and in which is shown by way of illustration specific exemplary embodiments in which the invention may be practiced. These embodiments are described in sufficient detail to enable those skilled in the art to practice the invention, and it is to be understood that other embodiments may be utilized and that changes may be made without departing from the scope of the present invention. The following description is, therefore, not to be taken in a limited sense. Wherever possible, the same reference numbers are used throughout the drawings to refer to the same or like parts.

Figure 1:
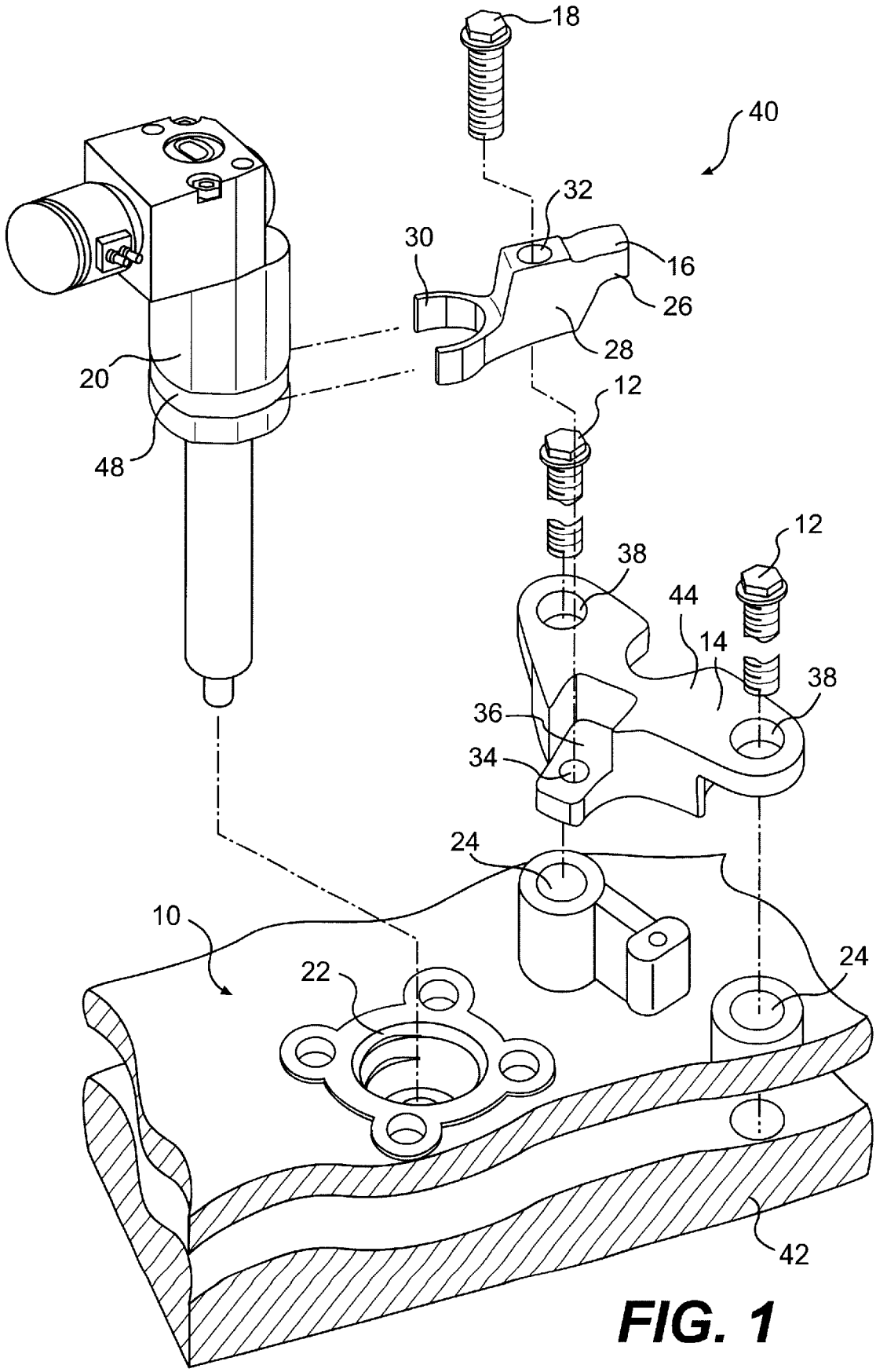
FIG. 1 is an exploded diagrammatic view of a fuel injector, fuel injector support assembly, and cylinder head according to an exemplary embodiment of the present invention.

FIG. 1 depicts an exploded view of a fuel injector support assembly according to an exemplary embodiment of the present invention. As shown in FIG. 1, a cylinder head 10 of an engine is configured with a fuel injector port 22, into which a fuel injector 20 is inserted. The fuel injector 20 may be held in place within fuel injector port 22 by a fuel injector support assembly 40. The fuel injector support assembly 40 requires no dedicated holes in the cylinder head 10. In other words, cylinder head 10 includes no holes that are used solely for the purpose of fastening fuel injector support assembly 40 to cylinder head 10. Instead of requiring additional dedicated holes bored into cylinder head 10, the fuel injector support assembly 40 may be mounted to cylinder head 10 using preexisting cylinder head mounting bolts 12, which extend through cylinder head 10 and fasten cylinder head 10 to an engine block 42.

It should be noted that FIG. 1 shows only a representative portion of cylinder head 10 and the engine block 42. Also, FIG. 1 shows only two cylinder head mounting bolts 12 and one fuel injector 20. Generally, however, there may be additional cylinder head mounting bolts 12 used to mount cylinder head 10 to engine block 42. There also may be multiple fuel injectors, in addition to fuel injector 20, mounted to cylinder head 10. Further, there may be multiple cylinder heads 10, depending on the size and configuration of the engine.

In one exemplary embodiment of the present invention, the fuel injector support assembly 40 includes a bracket 14, a fuel injector clamp 16, and a fastener 18. The fuel injector clamp 16 may be attached to the bracket 14 using fastener 18. While fastener 18 is illustrated in this exemplary embodiment as a threaded bolt, one skilled in the art will appreciate that other suitable fasteners may be used depending on a particular application. Moreover, while bracket 14 and fuel injector clamp 16 are shown as separate components, it is contemplated that they could be formed integrally.

In an exemplary embodiment of the present invention, bracket 14 may be configured generally in the shape of a "V". At each end of the "V" shape is a bracket mounting hole 38 that may receive a cylinder head mounting bolt 12. Bracket mounting holes 38 are located on the bracket such that they may coincide with the position of a pair of cylinder head mounting bosses 24 residing on the cylinder head 10. In order to mount the bracket 14 to the cylinder head 10, the bracket is positioned on the cylinder head mounting bosses 24, and the cylinder head mounting bolts 12 are securely engaged with the engine block 42.

Mounting the bracket 14 to the cylinder head 10 in this manner effectively increases the amount of material through which the cylinder head mounting bolts 12 must penetrate in order to reach the engine block 42. Specifically, in addition to the thickness of the cylinder head 10, which includes the height of the mounting bosses 24, the cylinder head mounting bolts 12 must also extend through the thickness of the bracket 14 at the location of the mounting bosses 24. As a result of this extra material, a standard length cylinder head mounting bolt 12 will not penetrate into the engine block 42 to the same depth as those cylinder head mounting bolts 12 not used to mount a bracket 14. In order to maintain a uniform penetration depth of the cylinder head mounting bolts 12 into the engine block, longer bolts may be used at the locations where bracket 14 is fastened to the cylinder head 10. Alternatively, the cylinder head mounting bosses 24 used to mount the bracket 14 may be reduced in height by an amount equal to the thickness of the bracket 14. Reducing the height of the cylinder head mounting bosses at these locations preserves the ability to use cylinder head mounting bolts 12 of similar length at all cylinder head mounting locations, including those used to mount the bracket 14.

Bracket 14 may include a recessed portion 36, which may be configured to receive fuel injector clamp 16. A fastener hole 34 may be located within recessed portion 36 for receiving fastener 18. Fastener hole 36 may be a threaded hole to accommodate embodiments in which fastener 18 is a threaded bolt.

Fuel injector clamp 16 may have three portions, which include a forked arm 30, a central body 28, and a heel 26. Forked arm 30 is utilized to engage the fuel injector 20. Forked arm 30 may include any shape or configuration suitable for engaging fuel injector 20. In the exemplary embodiment illustrated in FIG. 1, forked arm 30 is depicted as having a generally semi-circular configuration with planar interior segments. Other configurations, however, may be suitable. For example, in addition to the semi-circular configuration, forked arm 30 may include a rectangular, elliptical, or V-shaped configuration and/or any combination thereof. The shape of forked arm 30 should be such that it securely engages a recessed band 48 located on the fuel injector 20. Through such engagement, the forked arm 30 couples the fuel injector 20 with the fuel injector clamp 16.

Opposite the forked arm 30, fuel injector clamp 16 may include a heel 26. In the exemplary embodiment, heel 26 constitutes a tab-like protrusion that contacts a planar area 44 of the bracket 14 when the fuel injector clamp 16 is mounted to the bracket 14. Ultimately, heel 26 provides support against the loads placed on the fuel injector 20 and aids in transferring these loads through the bracket 14 to the cylinder head mounting bolts 12.

The area of the fuel injector clamp 16 located between the forked arm 30 and the heel 26 constitutes the central body 28. A fastener hole 32 for receiving the fastener 18, which is used to attach the fuel injector clamp 16 to the bracket 14, may be disposed through central body 28. Alternatively, the position of fastener hole 32 can be varied within fuel injector clamp 16.

In this exemplary embodiment, once the bracket 14 has been secured to the cylinder head 10, using cylinder head mounting bolts 12, the fuel injector 20 and the fuel injector clamp 16 may be assembled together and fastened to the bracket 14. Alternatively, the components could be assembled individually or as a subassembly. The fuel injector 20 is assembled together with the fuel injector clamp 16 such that the forked arm 30 engages the recessed band 48 on the fuel injector body. Once the fuel injector 20 and the fuel injector clamp 16 have been secured together, the fuel injector 20 may be inserted into the fuel injector port 22 located on the cylinder head 10. While inserting the fuel injector 20 into the fuel injector port 22, the fuel injector clamp 16 is positioned such that the central body 28 and the fastener hole 32 of the fuel injector clamp align with the recessed portion 36 and the fastener hole 34 on the bracket 14.

The fuel injector clamp 16 is lowered into place until the central body 28 is located within the recessed portion 36 and the heel 26 of the clamp 16 contacts with planar area 44 of the bracket 14. The fastener 18 is then inserted through fastener hole 32 into fastener hole 34 and tightened into fastener hole 34.

Figure 2:
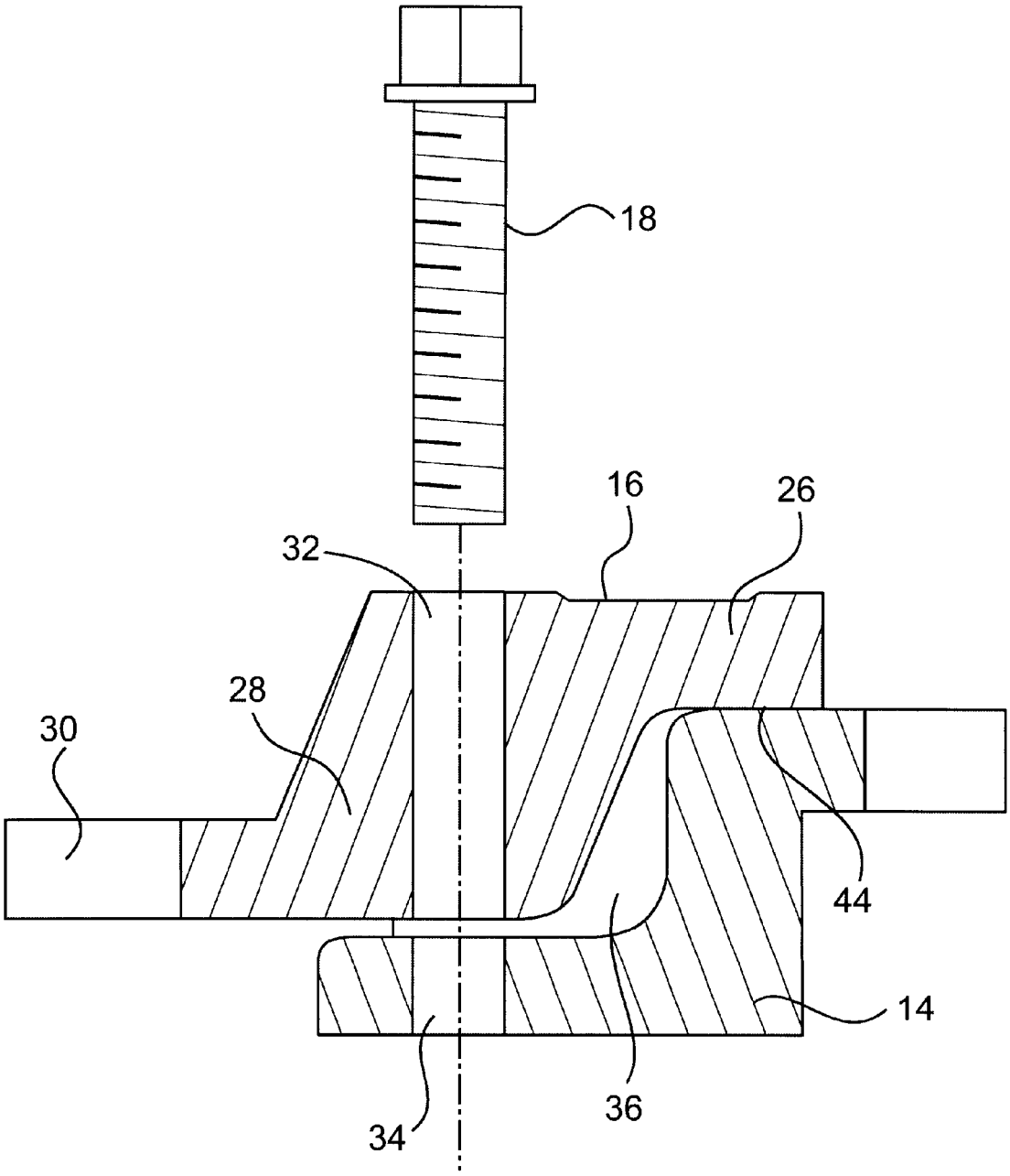
FIG. 2 is a cross-sectional, diagrammatic view of the fuel clamp, the bracket, and the fastener in an exemplary embodiment of the present invention.

Tightening of the fastener 18 into hole 34 creates a downward force on fuel injector 20. This downward force is created by a pivoting, lever action of the fuel injector clamp 16. FIG. 2 provides a cross-sectional view of the fuel injector clamp 16, the bracket 14, and the fastener 18. Central body 28 is dimensioned such that the central body 28 does not contact the bracket 14. In the exemplary embodiment, a clearance of about 3 mm may be maintained between the lower surface of the central body 28 and the floor of the recessed portion 36 upon tightening of the fastener 18. Other clearance values may be suitable as long as the lower surface of the central body 28 and the floor of the recessed portion 36 do not contact one another after the fuel injector 20 has been secured.

Except for the fastener 18 that extends through clamp 16 and into bracket 14, fuel injector clamp 16 contacts the bracket 14 only via the heel 26, which seats against the bracket 14 at the planar area 44, as shown in FIG. 2. Therefore, tightening of the fastener 18 into the fastener hole 34 on the bracket 14 causes the fuel injector clamp 16 to pivot about a point of contact, which is created by the heel 26 seating against the bracket 14. As a result of this pivoting motion, the fuel injector 20 is forced downward into the fuel injector port 22 by a downward force imparted through the forked arm 30 of the fuel injector clamp 16.

Ultimately, the downward force on the fuel injector serves to create a seal between the fuel injector body and the cylinder head 10. The magnitude of this downward force applied to the fuel injector 20 should also be sufficient to counter-balance the effect of the cylinder pressure while, at the same time, it should maintain the seal between the fuel injector 20 and the cylinder head 10. The pressure in the cylinder head, which may be up to, for example, about 17 MPa, acts on the fuel injector 20 in a direction that tends to force the fuel injector 20 out of the cylinder head 10. In an exemplary embodiment of the present invention, the amount of pre-load necessary to hold the fuel injector 20 in place without breaking the seal with the cylinder head 10 is transmitted through the fastener 18 as it is tightened into the bracket 14. As a result, all of the fuel injector clamping load is carried through the bracket 14 to the cylinder head mounting bolts 12.

Figure 3:
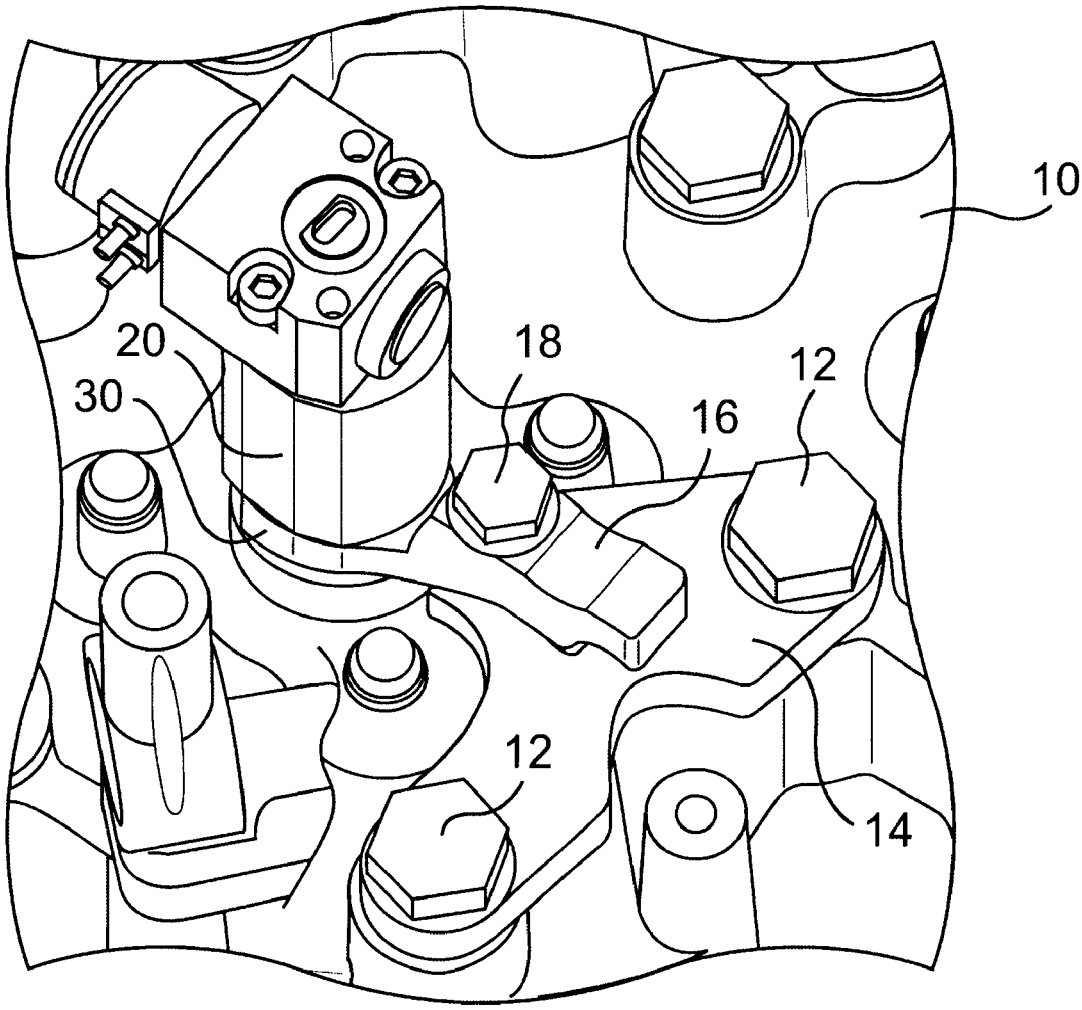
FIG. 3 is a perspective, diagrammatic view of the fuel injector, the fuel injector support assembly, and the cylinder head in an exemplary embodiment of the present invention.

FIG. 3 provides a perspective view of a portion of the cylinder head 10 where the components of an exemplary embodiment of the present invention are assembled. Here, bracket 14 is shown mounted to the cylinder head 10 using two of the cylinder head mounting bolts 12. Fuel injector clamp 16 is fastened to the bracket 14 using fastener 18. Further, as illustrated, the forked arm 30 of fuel injector bracket 16 engages with the fuel injector 20 and presses fuel injector 20 into the deck of cylinder head 10.

INDUSTRIAL APPLICABILITY

The present invention, by using pre-existing cylinder head mounting bolts to fasten the fuel injector support assembly 40 to the cylinder head 10, removes the need for an additional mounting hole in the deck of the cylinder head. As a result, the present invention eliminates a possible structural weakness in the cylinder head. The added structural integrity of the cylinder head 10 may allow the engine to be operated at higher cylinder pressures without added risk of structural failure.

Further, because the present invention obviates the need for an additional mounting hole in the deck of the cylinder head 10, the cylinder head 10 of the present invention is less expensive to fabricate and may be cooled more easily than cylinder heads that include mounting holes dedicated for a fuel injector support device. Specifically, the molds for creating the cylinder head 10 are less complicated because they do not have to create additional bosses on the cylinder head 10 to accept mounting holes dedicated solely to a fuel injector support device. Further, no additional steps for creating the added mounting holes, such as tapping the mounting holes, are necessary. As an added benefit, because no bosses dedicated to mounting of a fuel injector support are present on the cylinder head 10, there is less material used to create the cylinder head 10. As a result, the cooling efficiency of the engine may be improved.

It is contemplated that embodiments of the present invention have wide application to a variety of engines using a variety of fuel injectors. Other aspects and features of the present invention can be obtained from a study of the drawings, the disclosure, and the appended claims.

What is claimed is:

1. An engine, comprising:

an engine block;

a cylinder head having at least one surface;

at least one cylinder head mounting bolt that fastens the cylinder head to the engine block;

a bracket having a first surface and a second surface, the bracket being mounted to the cylinder head using the at least one cylinder head mounting bolt, wherein the first surface of the bracket contacts the at least one surface of the cylinder head; and a fuel injector clamp having at least one surface, the fuel injector clamp being attached to the bracket, wherein the at least one surface of the fuel injector clamp is in contact with the second surface.

2. The engine of claim 1, wherein the bracket includes at least one hole that aligns with and accepts the at least one cylinder head mounting bolt.

3. The engine of claim 1, wherein the bracket includes a recessed portion that accepts the fuel injector clamp.

4. The engine of claim 1, further including a fuel injector attached to the fuel injector clamp.

5. The engine of claim 4, wherein the fuel injector clamp includes a heel having the at least one surface that contacts the second surface of the bracket and a forked arm that receives the fuel injector.

6. The engine of claim 1, wherein the fuel injector clamp is attached to the bracket using a fastener.

7. The engine of claim 6, wherein the fuel injector clamp includes a heel having the at least one surface that contacts the second surface of the bracket, a forked arm that receives a fuel injector, and a central body, located between the heel and the forked arm, that receives the fastener.

8. The engine of claim 7, wherein, upon tightening of the fastener, the fuel injector clamp pivots about a point of contact, located where the heel contacts the bracket, such that a downward force is transferred through the forked arm to the fuel injector.

9. An engine comprising:

an engine block;

a cylinder head secured to the engine block;

a fuel injector configured to be secured to the cylinder head; and means for both fastening the cylinder head to the engine block and fastening the fuel injector to the cylinder head, wherein the cylinder head includes at least one surface and the means for fastening the cylinder head to the engine block and for fastening the fuel injector to the cylinder head includes:

a plurality of cylinder head mounting bolts;

a bracket having a first surface and a second surface, the bracket being mounted to the cylinder head using at least one of the plurality of cylinder head mounting bolts, wherein the first surface of the bracket contacts the at least one surface of the cylinder head, and a fuel injector clamp having at least one surface, the fuel injector clamp being attached to the bracket, wherein the at least one surface of the fuel injector clamp is in contact with the second surface.

10. The engine of claim 9, wherein the bracket includes a recessed portion that accepts the fuel injector clamp.

11. The engine of claim 9, wherein the fuel injector clamp includes a heel having the at least one surface that contacts the second surface of the bracket at a point of contact and a forked arm that receives the fuel injector.

12. The engine of claim 11, wherein the fuel injector clamp pivots about the point of contact such that a downward force is transferred through the forked arm to the fuel injector.

13. A method of fastening a fuel injector to an engine, comprising:

securing a cylinder head having at least one surface to a block of the engine using a plurality of cylinder head mounting bolts;

mounting a fuel injector support assembly to the cylinder head using at least one of the plurality of cylinder head mounting bolts; and securing a fuel injector to the fuel injector support assembly, wherein the fuel injector support assembly includes:

a bracket having a first and a second surface, the bracket being mounted to the cylinder head by the at least one of the plurality of cylinder head mounting bolts, wherein the first surface is in contact with the at least one surface of the cylinder head; and a fuel injector clamp having at least one surface, the fuel injector clamp being attached to the bracket, wherein the at least one surface is in contact with the second surface.

14. The method of claim 13, wherein the bracket includes at least one hole that aligns with and accepts the at least one of the plurality of cylinder head mounting bolts.

15. The method of claim 13, wherein the bracket includes a recessed portion that accepts the fuel injector clamp.

16. The method of claim 13, wherein the fuel injector clamp includes a heel having the at least one surface that contacts the second surface of the bracket at a point of contact and a forked arm that receives the fuel injector.

17. The method of claim 16, wherein the fuel injector clamp pivots about the point of contact such that a downward force is transferred through the forked arm to the fuel injector.

18. An engine comprising:

an engine block;

a cylinder head secured to the engine block by a plurality of cylinder head mounting bolts, the cylinder head having at least one surface;

a bracket having a recessed portion, a first surface, and a second surface, the bracket being mounted to the cylinder head using at least one of the plurality of cylinder head mounting bolts, wherein the first surface of the bracket contacts the at least one surface of the cylinder head;

a fuel injector clamp having at least one surface and being attached to the bracket using a threaded fastener that mates with a threaded bore located in the recessed portion of the bracket, the at least one surface of the fuel injector clamp being in contact with the second surface, wherein the fuel injector clamp has a forked arm that receives a fuel injector and a heel that contacts the bracket; and a fuel injector engaged by the forked arm of the fuel injector clamp and secured to the cylinder head by a downward force created upon tightening of the threaded fastener into the threaded bore.

19. A fuel injector support assembly, comprising:

a bracket that mates with at least one mounting boss of a cylinder head of an engine; and a fuel injector clamp mated to the bracket and configured to securely engage a fuel injector.

20. The fuel injector support assembly of claim 19, wherein the bracket includes a recessed portion that receives the fuel injector clamp, and wherein the fuel injector clamp includes a heel that contacts the bracket.

21. The fuel injector support assembly 19, further including a fastener that secures the fuel injector clamp to the bracket, wherein the fastener is a threaded fastener that extends through the fuel injector clamp and into a threaded bore in the bracket.

22. The fuel injector support assembly 19, wherein the bracket and fuel injector clamp are formed together as an integral unit.

* * * * *